United States Patent [19]

Marlow et al.

[11] 4,254,675

[45] Mar. 10, 1981

[54] REVERSIBLE RATCHET WRENCH

[76] Inventors: James T. Marlow, Box 36, Rte. 1, Evensville, Tenn. 37332; Carroll M. Bridges, 1637B Hamlet Dr., Chattanooga, Tenn. 37421

[21] Appl. No.: 85,714

[22] Filed: Oct. 17, 1979

[51] Int. Cl.[3] ..... B25B 13/46

[52] U.S. Cl. ..... 81/63; 192/43.1

[58] Field of Search ..... 81/62, 63; 192/43.1

[56] References Cited

U.S. PATENT DOCUMENTS

| | | | |
|---|---|---|---|
| 349,007 | 9/1886 | Sinclair | 81/62 |
| 3,659,484 | 5/1972 | Scodeller | 81/63 |
| 3,724,298 | 4/1973 | Howard | 81/63 |

*Primary Examiner*—James L. Jones, Jr.

*Attorney, Agent, or Firm*—Alan Ruderman

[57] ABSTRACT

A reversible ratchet wrench having a pivotable pawl element including a pair of pawls and a cam surface corresponding to each pawl. A resilient pusher member is eccentrically carried by a control rod and acts against the cam surfaces to pivot the pawl member when the rod is rotated. The rod is rotatably secured to a barrel located about and rotatably fixed to the body of the wrench in one axial position. The barrel has a detent positioned in one of two circumferentially spaced slots in the body in the first position, and in a circumferential notch in a second position. The slots open into the notch to allow axial movement and a spring urges the barrel toward the first position but is manually overcome to move the barrel to the second position for reversing.

13 Claims, 4 Drawing Figures

REVERSIBLE RATCHET WRENCH

BACKGROUND OF THE INVENTION

This invention relates to hand held ratchet wrenches and more particularly to a wrench of this type in which the direction of turning can be reversed simply and readily by one hand without necessitating removal of the wrench from the work or removal of the hand from the normal torque applying position.

Reversible ratchet wrenches whether of the type using a socket member to rotate and torque a workpiece or having gripping teeth to rotate and torque a workpiece without the imposition of a socket member are notoriously well known. These wrenches include a ratchet wheel and pawl members which engage the teeth of the wheel to prevent rotation in one direction selectively and alternately permit rotation in the other direction. In the known reversible ratchet wrenches the means for selectively engaging and disengaging the pawls require the use of two hands, a repositioning of the wrench holding hand or at best use of the palm or an unnatural bending of the wrench holding hand to manipulate the direction selector. A common location for the selector is axially above the wheel which requires the use of the second hand to turn the selector when the wrench is positioned on the work. It is often the case that the wrench must be positioned in an inconvenient or tightly spaced location and the operator finds that the direction selector must be repositioned. If there is insufficient room to insert the second hand, and if the work will not secure the wrench, the wrench must be removed to adjust the selector and repositioned on the work. In U.S. Pat. Nos. 743,942; 1,177,764; 2,590,387 and 2,851,914 provision is made for a selector at the end of the handle of the wrench. In the last mentioned patent a pawl selecting lever is pivotably positioned at the end of the handle while in the other aforesaid patents a rotatable knob is positioned at the end of the handle, each thereby requiring a repositioning of the hand or an unnatural bending thereof.

SUMMARY OF THE INVENTION

Consequently, it is a primary object of the present invention to provide a reversible ratchet wrench having a direction selector conveniently disposed and operable by a simple manipulation of the operator's hand.

It is another object of the present invention to provide a reversible ratchet wrench having a direction selector operable by a twisting action applied to the handle.

It is a further object of the present invention to provide a reversible ratchet wrench wherein the ratchet wheel direction is selectible by a handle member normally rotatably secured to the body of the wrench and axially movable to a position where a twist applied to the handle member reverses the direction of the ratchet wheel rotation.

To this end the present invention provides a ratchet wrench having a reversing mechanism including an operator influenced barrel rotatably secured to the body of the wrench in a first axial position and movable to a second axial position where it is rotatable relatively to the wrench body, and a control rod journaled in the body and rotatably secured to the barrel, the control rod having a pawl moving element which forces one of the pawl members into and the other out of the ratchet wheel teeth as determined by the rotational position of the control rod. The barrel carries a radial detent receivable in one of a pair of slots interposed substantially 180 degrees apart in the body in the first axial position, and a circumferentially extending notch axially spaced from the slots and communicating therewith at the second axial position of the barrel, the barrel preferably being resiliently urged toward the first position. The pawl moving element is eccentrically carried in a recess in the rod and is resiliently urged into engagement with cam surfaces associated with each pawl member, the surfaces connverging to a junction forming the high point of the cams relatively to the control rod. As the rod turns, the element is forced into the recess as it moves along one cam surface toward the junction and after passing the junction is released from the recess to engage the other cam surface to forcibly disengage the previously engaged pawl and engage the previously disengaged pawl with the ratchet wheel.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
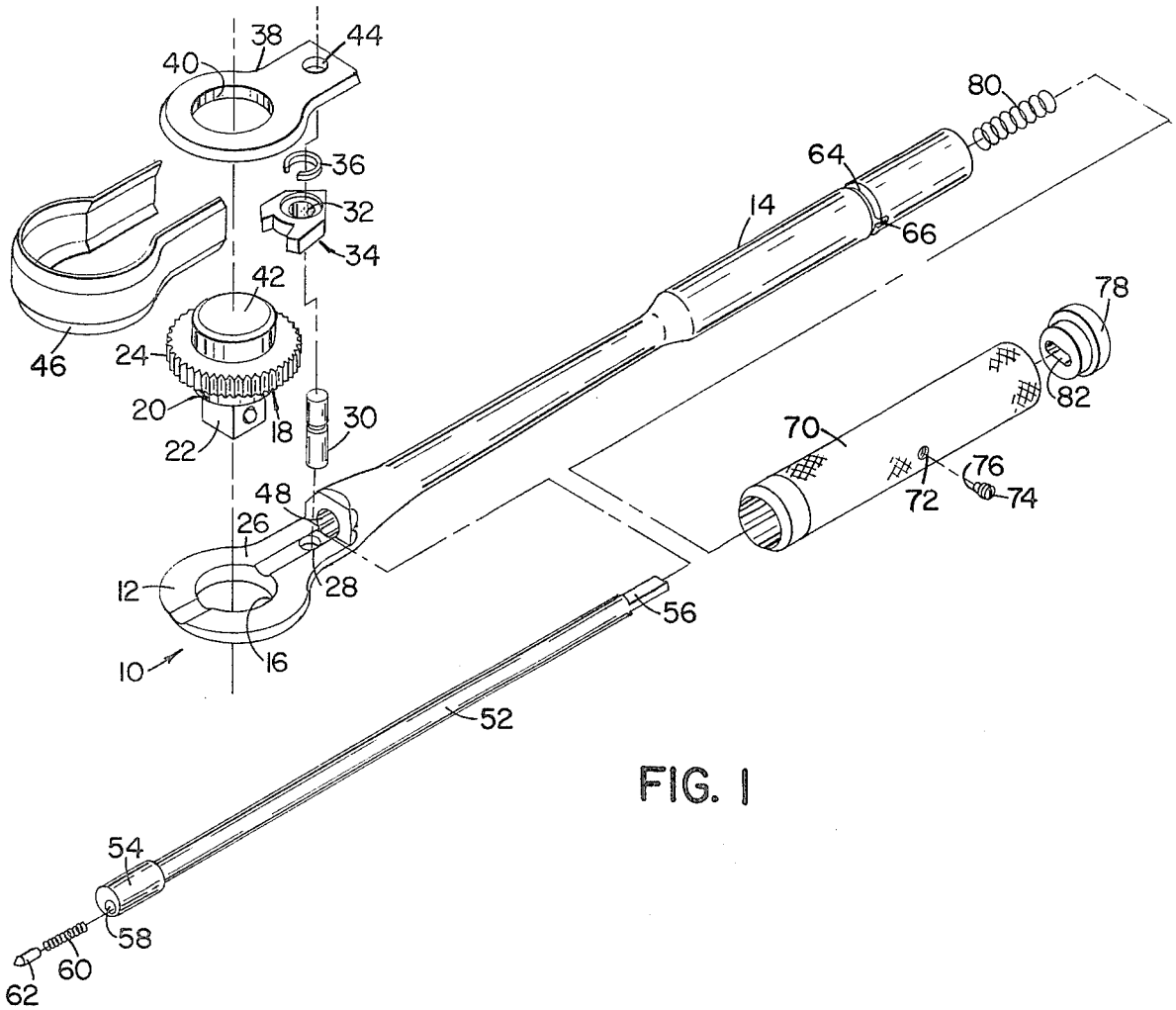
FIG. 1 is a dissassembled perspective view of a ratchet wrench embodying reversing mechanism constructed in accordance with the present invention.

Referring now to the drawings, the wrench comprises a longitudinally extending body member 10 having a head including a socket receiving portion 12, and a handle portion 14 spaced therefrom and forming the remainder of the body member. The socket receiving portion 12 includes an aperture 16 for rotatably receiving a socket member 18 including a collar 20 to which a socket pin 22 and a toothed ratchet wheel 24 are securely attached on opposite faces thereof. The collar 20 is slightly smaller than the aperture 16 and is received therein for rotation, while the wheel 24 is positioned on the inner face 26 of the socket receiving portion 12.

In the face 26 of the socket receiving portion rearwardly of the aperture 16, is a second and smaller aperture 28 for receiving one end of a journal pin 30 which extends through a hole 32 in a pawl element 34 and pivotably supports the pawl element on the socket receiving portion 12. A lock washer 36 or other such expedient may be secured to the pin 30 to maintain it within the holes 28 and 32. The socket receiving portion is enclosed by a cover plate 38 having an aperture 40 for receiving a hub 42 on the wheel 24 in a manner similar to receipt of the collar 20 in the aperture 16, and a smaller hole 44 for receiving the other end of the pin 30. A clamping cap 46 of substantially the same configuration as the cover plate but capable of engaging the cover plate and the socket receiving portion is positioned about the head end of the wrench to secure the cover plate thereon with the socket member, pawl element and journal entrapped therebetween.

Figure 2:
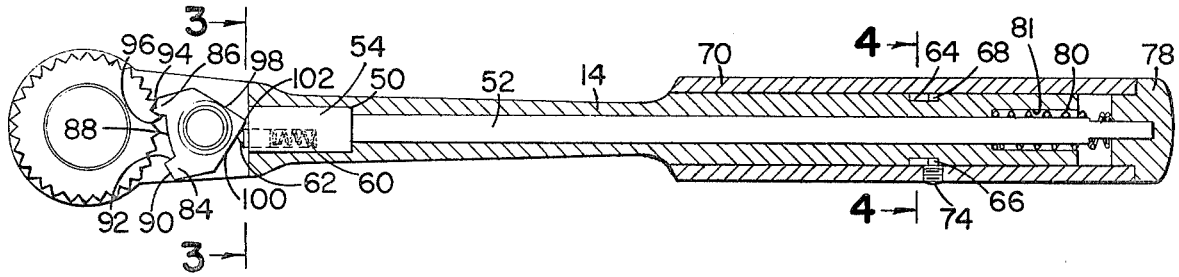
FIG. 2 is a plan view of the wrench illustrated in FIG. 1 with the clamping cap and cover removed and with the body partly sectioned for clarity of presentation.
Figure 3:
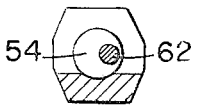
FIG. 3 is a cross sectional view taken substantially along line 3—3 of FIG. 2.
Figure 4:
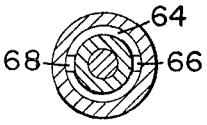
FIG. 4 is a cross sectional view through the notch taken substantially along line 4—4 of FIG. 2.

Longitudinally extending through the handle portion 14 of the wrench is a bore 48 which may be counterbored as illustrated in FIG. 2 at 50 in the handle portion adjacent the socket receiving portion. A control rod 52, which is positionally journaled within the bore 48 preferably includes an enlarged head end 54 recessed in the counterbore 50, and a noncircular (rectangular, as illustrated) tail end 56 extending beyond the tail end of the handle portion. Formed eccentrically in the free end face of the enlargement 54 is a longitudinally extending recess 58 within which a coil spring 60 and an elongated pin 62 are received, the pin extending out the rod and further urged in that direction by the spring.

The tail part of the handle portion is of cylindrical configuration and includes a circumferential notch 64. Axially spaced rearwardly from the notch 64 are a pair of slots 66 and 68 spaced substantially 180 degrees apart and elongated axially to open into the notch. As will be understood the notch need not extend fully about the handle portion but must extend circumferentially from slot 66 to slot 68.

Positioned about the handle portion 14 is a cylindrical barrel 70 sized for rotation relatively to the handle portion. A hole 72 is radially disposed intermediate the longtitudinal extent of the barrel and may be threaded to receive a threaded screw like member 74 having a non-threaded end 76 remote from its head, the end 76 defining a detent member. The detent 76 extends radially inwardly beyond the inner wall of the barrel 70 and the surface of the handle portion and is of a size and configuration to be received within the notch 64 and the slots 66 and 68. The outer tail end of the barrel 70 is enclosed by a cap 78 which may be press fitted thereon. A coil spring 80 which may be seated at one end in an axially counterbored hole 81 in the tail end of the handle portion is positioned about the tail portion of the control rod 52 for abuttment with the cap 78 at the other end. Formed in the inner end of the cap 78 is a non-circular recess 82 of substantially the same cross-sectional configuration as the non-circular tail end 56 of the control rod but slightly larger for receiving the control rod and providing a rotational connection therebetween while permitting some clearance for axial movement of the rod. The recess preferably may be of an axial depth at least equal to the initial axial depth of the end 56 therein plus the axial spacing between the notch 64 and the slot 66, 68 so that the barrel may be moved axially through that distance without moving the control rod to avoid interference of the enlarged head 54 with the pawl element 34. However, this is not necessary for operation of the reversing mechanism since the same effect can be obtained by shortening the enlarged end 54 and increasing the length of the pin 62.

Referring to FIG. 2, the pawl element 34 preferably comprises a one piece block having a pair of spaced apart ears 84 and 86 radially disposed thereon relatively to the journal pin 30. The ears 84,86 project beyond the margin of the intermediate joining surface 88 and have tapered edges 90,92 and 94,96 respectively which define the ears as tooth shaped pawl members each receivable within the valley between adjacent teeth of the wheel 24. The angular relationship between the surfaces 90 and 92, and the surfaces 94 and 96 are such that when the pawl member 84 engages the teeth the wheel 24 may rotate clockwise as viewed in FIG. 2 but is prevented from rotating counter-clockwise, and alternatively when the pawl member 86 is engaged with the teeth the wheel may rotate counter-clockwise but is prevented from rotating clockwise as viewed in FIG. 2. Disposed radially oppositely to each pawl member 84,86 is a respective cam surface 98 and 100. Each of these surfaces preferably is substantially linear and the surfaces converge toward each other and away from the pawls toward a junction 102 spaced slightly from the outer face of the enlarged end 54 of the control rod 52 so as not to engage the rod. It is to be understood that the axial depth of the recess 58 is such that the pin 62 can be forced against and compress the spring 60 as the junction 102 moves across the center-line of the rod when the pawl element 34 is pivotably moved.

In operation, with the rotational direction of the wheel 24 pre-selected the wrench can be conventionally used to turn a work-piece in the selected direction. The barrel 70 forms the gripping handle of the wrench and is held by the operator. In normal use the barrel is urged rearwardly by the spring 80 and the detent 76 is positioned within one of the slots 66 or 68 thereby preventing relative rotation between the barrel and the body member. At this time the rod is angularly disposed such that the pin 62 is between the top and bottom dead center position, preferably half-way between at the 90 degree position, and in engagement with the cam surface opposite to the engaged pawl member. When it is desired to reverse the rotational direction of the ratchet wheel 24 the operator merely pushes the barrel toward the head end of the wrench until the detent enters the notch 64 and then rotates the barrel in either direction. Of course if the notch 64 merely extends half way around the handle portion the barrel would only be capable of then rotating in one direction, that being from the engaged slot 66,68 to the disengaged slot 68, 66. As the barrel rotates so does the control rod 52 and the pin 62. Since the pin is eccentrically mounted in the rod 52 it rides up or down (depending on the direction of rotation) the engaged cam surface until it reaches the junction 102. As the pin moves along the cam surface it is urged into the recess and when the pin engages the junction, the spring 60 is compressed to its full extent. Continued rotation of the barrel effects the movement of the pin past the junction and as it does the spring releases its energy and forces the pin outwardly against the newly engaged cam surface and forces the pawl element 24 to rotate quickly to engage the other pawl member 84,86 with the wheel 24, thereby permitting rotation of the wheel in the direction opposite to the initial direction and preventing rotation in the initial direction. At this time the detent 76 is disposed substantially axially to the new slot 66, 68 and the barrel is forced outwardly by the spring to positionally lock the detent into the slot. The wrench may now be used for rotating the work in the opposite direction to that initially pre-selected.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. A reversible ratchet wrench having a body member including a socket receiving portion at one end and a handle portion longitudinally spaced therefrom, and a socket member including a ratchet wheel rotatable in said socket receiving portion, pawl means including a pair of oppositely disposed pawl members, journal means for pivotably mounting said pawl means for cooperative engagement of said pawl members with said ratchet wheel, each pawl member having wheel engaging and disengaging positions, and reversing means for turning said pawl means to position selectively one of said pawl members in said wheel engaging position and the other of said pawl members in said disengaged position for permitting rotation of said wheel in one direction, said reversing means comprising a control rod longitudinally journaled in said body member for rotation relatively thereto, presser means eccentrically carried by said control rod and disposed in engagement with said pawl means for turning said pawl means in a first direction to engage said one pawl member with said wheel and in the opposite direction to engage said other pawl member with said wheel in response to the rotational position of said rod, a barrel disposed about said handle portion and axially movable relatively thereto, coupling means for rotatably securing said barrel to said handle portion in a first axial position and for permitting rotation of said barrel in a second axial position, and means for rotatably securing said control rod to said barrel, whereby operator influenced movement of said barrel to said second axial position and subsequent rotation thereof rotationally repositions said rod to turn said pawl means.

2. A reversible ratchet wrench as recited in claim 1, wherein said coupling means comprises a detent carried by said barrel projecting radially from the interior thereof, a notch extending about the periphery of said handle portion for at least substantially 180 degrees and adapted to receive said detent, a pair of detent receiving slots in said handle portion disposed substantially 180 degrees apart and opening into said notch, said slots defining said first axial position and said notch defining said second axial position of said barrel.

3. A reversible ratchet wrench as recited in claim 2, including biasing means for urging said barrel axially from said notch and toward said slots.

4. A reversible ratchet wrench as recited in claim 3, wherein said slots are disposed axially further from said socket receiving portion than is said notch.

5. A reversible ratchet wrench as recited in claim 1, wherein said pawl means comprises a unitary pawl element, said journal means being disposed intermediate said wheel and said rod, said pawl members being radially disposed on said element and arcuately spaced one from the other, said pawl element including a cam surface corresponding to each pawl member disposed radially opposite to the respective pawl member, said cam surfaces converging toward a junction intermediate said journal means and said rod, said presser means being engagable with said cam surfaces and said junction in response to the rotational position of said rod.

6. A reversible ratchet wrench as recited in claim 1, wherein said pawl means includes a cam surface corresponding to each pawl member, said surfaces converging toward a junction, said presser means comprising an elongated pusher member and biasing means for urging said pusher member toward engagement with said cam surfaces, said surfaces having a configuration and disposition relative to said journal means to move said pusher member toward said biasing means to store energy therein as said pusher member rotates toward a position for engagement with said junction and to release said energy as the pusher member rotates out of engagement with said junction and into engagement with a selected cam surface.

7. A reversible ratchet wrench as recited in claim 1 wherein said presser means comprises an elongated pusher member, means in said control rod defining a recess disposed eccentrically at an end thereof, said pusher member being disposed in said recess, and means for urging said pusher member outwardly from said recess toward said pawl means.

8. A reversible ratchet wrench as recited in claim 7, wherein said means for rotatably securing said control rod to said barrel includes means for permitting axial movement of the barrel relatively to said rod.

9. A reversible ratchet wrench as recited in claim 2, wherein said pawl means comprises a unitary pawl element, said journal means being disposed intermediate said wheel and said rod, said pawl members being radially disposed on said element and arcuately spaced one from the other, said pawl element including a cam surface corresponding to each pawl member disposed radially opposite to the respective pawl member, said cam converging toward a junction intermediate said journal means and said rod, said presser means being engagable with said cam surfaces and said junction in response to the rotational position of said rod.

10. A reversible ratchet wrench as recited in claim 2, wherein said pawl means includes a cam surface corresponding to each pawl member, said surfaces converging toward a junction, said presser means comprising an elongated pusher member and biasing means for urging said pusher member toward engagement with said cam surfaces, said surfaces having a configuration and disposition relative to said journal means to move said pusher member toward said biasing means to store energy therein as said pusher member rotates toward a position for engagement with said junction and to release said energy as the pusher member rotates out of engagement with said junction and into engagement with a selected cam surface.

11. A reversible ratchet wrench as recited in claim 9, wherein said presser means comprises an elongated pusher member, means in said control rod defining a recess disposed eccentrically at an end thereof, said pusher member being disposed in said recess and means for urging said pusher member out of said recess toward said pawl means.

12. A reversible ratchet wrench as recited in claim 11, including biasing means for urging said barrel axially from said notch and toward said slots.

13. A reversible ratchet wrench as recited in claim 12, wherein said means for rotatably securing said control rod to said barrel includes means for permitting axial movement of the barrel relatively to said rod.

* * * * *